US006793094B2

(12) United States Patent
Turnbough

(10) Patent No.: US 6,793,094 B2
(45) Date of Patent: Sep. 21, 2004

(54) ANTI-TIPPING CONTAINER FOR LIQUIDS AND SEMI-SOLID FOODS

(76) Inventor: Mitchell Turnbough, 80 W. 40th St., New York, NY (US) 10018

( * ) Notice: Subject to any disclaimer, the term of this patent is extended or adjusted under 35 U.S.C. 154(b) by 0 days.

(21) Appl. No.: 10/264,596

(22) Filed: Oct. 3, 2002

(65) Prior Publication Data

US 2004/0065635 A1 Apr. 8, 2004

(51) Int. Cl.[7] ..... A61J 9/00; A61J 11/00; A47G 19/22; B65D 23/00; B65D 23/10

(52) U.S. Cl. ..... 220/603; 250/705; 250/771; 215/11.1; 215/365; 215/388; 215/396; 215/398

(58) Field of Search ..... 215/11.1, 365, 215/391, 396, 379, 388, 771; 220/603, 705; D24/198

(56) References Cited

U.S. PATENT DOCUMENTS

| | | | | | |
|---|---|---|---|---|---|
| 179,416 | A | | 7/1876 | Kennish | 215/11.1 |
| 524,894 | A | | 8/1894 | Forsberg | 220/603 |
| 730,337 | A | * | 6/1903 | Bonnefont | 215/6 |
| 1,070,516 | A | * | 8/1913 | O'Brien | 215/11.1 |
| 1,518,823 | A | | 12/1924 | Schmidt et al. | 215/11.1 |
| 2,014,236 | A | | 9/1935 | McNamara | 215/11.1 X |
| 2,090,749 | A | * | 8/1937 | Corsi et al. | 215/11.2 |
| 2,150,835 | A | | 3/1939 | Kazimirow | 215/11.1 |
| 2,163,330 | A | * | 6/1939 | Snapp | 119/71 |
| 2,175,735 | A | * | 10/1939 | Banks | 401/119 |
| 2,311,397 | A | | 2/1943 | Kazimirow | 215/11.1 |
| 2,366,214 | A | | 1/1945 | Ramaker | 215/11.1 X |
| 2,601,767 | A | | 7/1952 | Wall | 220/603 |
| 2,760,665 | A | | 8/1956 | Zenker | 215/11.1 |
| 2,816,548 | A | | 12/1957 | Tupper et al. | 215/11.1 |
| 2,953,170 | A | * | 9/1960 | Bush | 141/18 |
| 3,112,837 | A | | 12/1963 | Manoyian | 215/11.1 |
| 3,289,874 | A | | 12/1966 | Dailey et al. | 215/11.1 |
| 3,990,596 | A | * | 11/1976 | Hoftman | 215/11.1 |
| 4,096,966 | A | | 6/1978 | Korshak | 220/603 |
| D249,076 | S | | 8/1978 | Meeker et al. | 215/11.1 X |
| D287,766 | S | * | 1/1987 | Simmons | D24/198 |
| 4,782,670 | A | * | 11/1988 | Long et al. | 62/457.4 |
| 4,799,636 | A | | 1/1989 | Johnson | 248/102 |

(List continued on next page.)

FOREIGN PATENT DOCUMENTS

| | | | | |
|---|---|---|---|---|
| EP | 0201376 A2 | * | 11/1986 | |
| EP | 1177988 A1 | * | 6/2002 | |
| FR | 2595569 A1 | * | 9/1987 | 215/11.1 |
| GB | 1164969 | | 6/1968 | |
| GB | 2003039 A | * | 3/1979 | 215/11.1 |
| JP | 03289476 A | * | 12/1991 | |
| JP | 07112771 A | * | 5/1995 | |

*Primary Examiner*—Sue A. Weaver
(74) *Attorney, Agent, or Firm*—Drinker Biddle & Reath LLP

(57) ABSTRACT

A container of storing and dispensing liquids which is resistant to tipping. The container preferably has a substantially semi-spherical outer surface. The container includes a body with a top, a bottom and a side wall which form a substantial portion of the container and which define an interior cavity. The body has a central axis extending from the bottom to the top. A lid is removably attached to the top of the body. The lid includes a dispenser for dispensing liquids from within the container. A counterweight is located in the bottom of the container and is positioned so as to maintain the central axis substantially vertical when the container is placed on a surface. The container is particularly beneficial for small children, the elderly and the physically handicapped.

17 Claims, 12 Drawing Sheets

U.S. PATENT DOCUMENTS 4,930,645 A 6/1990 Warehime ..... 215/11.1
5,016,845 A 5/1991 Pellegrino ..... 248/4
5,076,463 A * 12/1991 McGraw ..... 220/592.17
5,082,115 A * 1/1992 Hutcheson ..... 206/545
5,088,948 A * 2/1992 Scheurer ..... 441/1
5,108,686 A 4/1992 Griffin ..... 215/11.1 X
5,294,018 A 3/1994 Boucher ..... 220/603
5,467,877 A * 11/1995 Smith ..... 215/11.1
5,476,881 A * 12/1995 Suh ..... 215/11.1 X
5,509,549 A * 4/1996 Marandola ..... 215/11.3
5,531,338 A * 7/1996 Sklar ..... 215/11.1
5,653,732 A 8/1997 Sheehy ..... 215/11.1 X
5,673,806 A 10/1997 Busnel ..... 215/11.1
5,690,679 A 11/1997 Prentiss ..... 215/11.6 X
5,807,156 A 9/1998 Owen ..... 215/11.1
5,975,983 A * 11/1999 Panec ..... 446/475
6,073,788 A * 6/2000 Stroud ..... 215/11.1
6,168,034 B1 * 1/2001 Perrone ..... 215/111
2001/0015340 A1 * 8/2001 Kolbel
2002/0033397 A1 * 3/2002 Henson

* cited by examiner

ANTI-TIPPING CONTAINER FOR LIQUIDS AND SEMI-SOLID FOODS

FIELD OF THE INVENTION

The present invention relates to containers and, in particular, to a spherical or semispherical anti-tipping container for liquid and semi-solid foods.

BACKGROUND OF THE INVENTION

There are a wide variety of containers on the market for storing and dispensing liquid and semi-solid foods. Many of those containers, however, are not designed to minimize or prevent tipping. As a result, the contents in the containers can easily spill. This is a prevalent problem with infants, toddlers, physically handicapped individuals, the elderly and the infirmed. In certain cases spillage can be harmful, for example, if the liquid or food item is hot. Even relatively warm contents can be harmful to infants and the infirmed.

To prevent this, some containers have been designed with wide, flattened bottoms which stabilize the container while it is resting on a table or other flat surface, thus minimizing the likelihood of the container tipping over. These types of prior art containers do not, however, provide any ability to self-right the container in the event that the container is dropped. Hence, spillage is still possible, and with infants and the infirmed, is highly likely.

A need therefore exists for an improved container which minimizes spillage and is easy to hold.

SUMMARY OF THE INVENTION

An object of the invention is to provide a container that minimizes spillage and is easy to hold for individuals with limited dexterity, such as infants, toddlers, the infirmed and the physically handicapped.

This and other objectives and advantages are provided by a container made in accordance with the present invention that can be easily held in a human hand by cupping or grasping depending on the person's dexterity. The container includes at least a rounded or semi-spherical bottom portion and, more preferably is substantially spherical in shape.

A counter-weight is formed or located in the bottom and is configured to self-right the container in the event the container tipped, thus preventing liquid from coming out of the container's dispensing or drinking top. The anti-tipping aspect of the invention also prevents the drinking top from touching any surface upon which the container is placed, thus making it more hygienic. The counter-weight may be permanent or removable.

In one aspect of the invention, the counter-weight is made of a material that absorbs thermal energy (i.e., heat and/or cold) so that it can be heated and/or cooled, thus providing a mechanism for maintaining the contents of the container at a desired temperature.

The container may include a removable top or lid which permits the use of a wide variety of drinking tops, including a rubber nipple, sipping spout, pop-up sports spout, or straw. The present invention also contemplates the use of a utensil lid which includes a fork and/or spoon for serving semi-solids from the container.

The container is preferably made from a shatterproof material, such as plastic, with antibacterial properties, and may be opaque, translucent or transparent.

A translucent level window may be included to assist in viewing the level of the contents within the container.

The foregoing and other features and advantages of the present invention will become more apparent in light of the following detailed description of the preferred embodiments thereof, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE PREFERRED EMBODIMENTS

Figure 1:
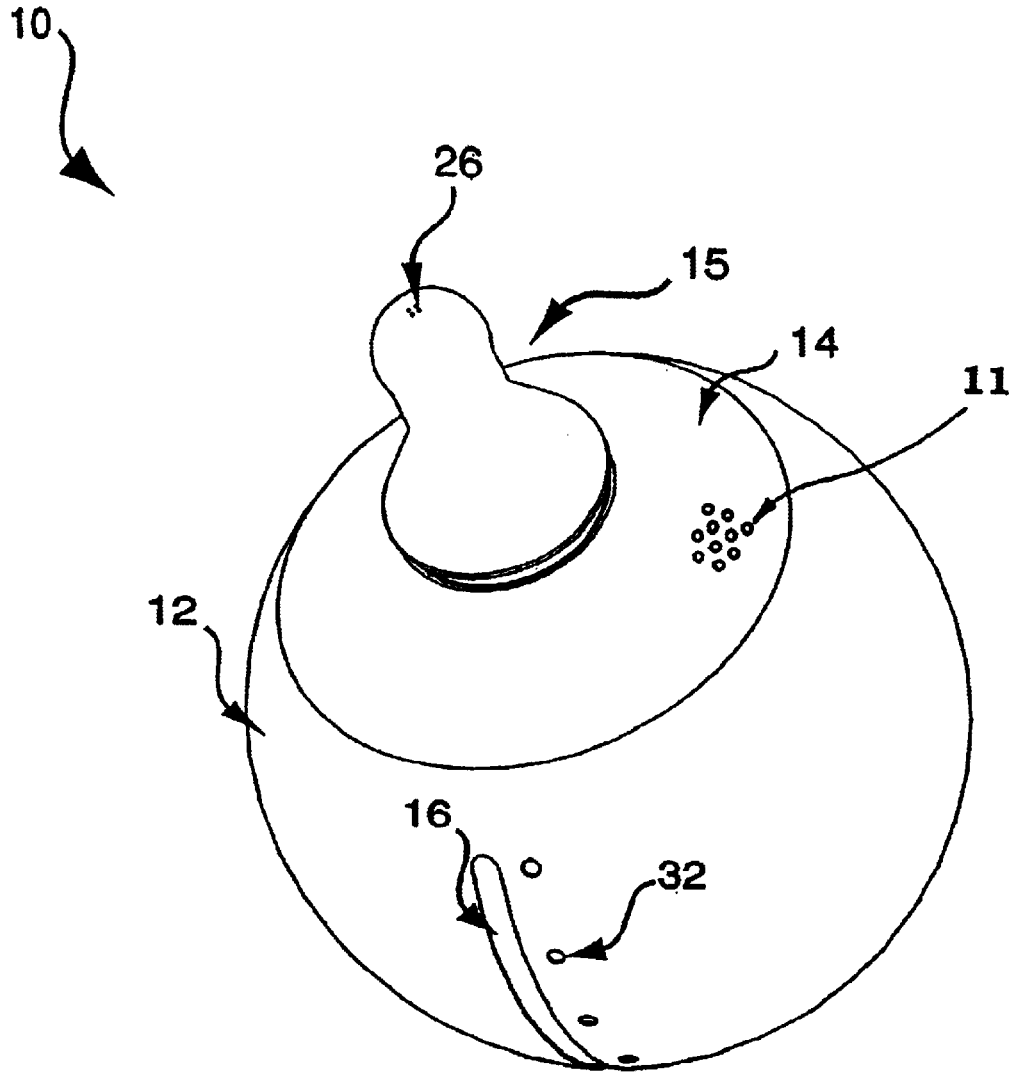
FIG. 1 is a perspective view of one preferred embodiment of the present invention.

Referring to the drawings, wherein like reference numerals illustrate corresponding or similar elements throughout the several views, FIG. 1 depicts one embodiment of a container according to the present invention intended to be used for dispensing liquids and semi-solids to infants, toddlers, children, teenagers, adults, the infirmed, and physically handicapped. Container 10 preferably includes a body 12, that includes at least a partially rounded or semi-spherical bottom or base portion 24. More preferably, as shown in the figures, substantially all of the body 12 is formed in a semi-spherical shape. It is also contemplated that the shape might be oblong as opposed to perfectly semi-spherical. The use of a shape with a rounded bottom permits the bottle to be self-righted as will be discussed below. Also, the rounded shape makes the bottle more intriguing and playful for a young child and is easy to grasp.

The container also includes a lid 14 that is attached to the body 12 as described herein. The lid 14 includes a dispenser which is generally depicted by the numeral 15. A wide variety of dispensers 15 can be used in the present invention, for example, a conventional nipple 26 (FIG. 1), a sipping spout 66 (FIG. 6), a pop-up sports spout (FIG. 8), a straw (FIG. 9), or a utensil (FIG. 10). The dispensers 15 may be formed integral with the lid 14 or be removably attached.

The body 12 and lid 14 may be made from a variety of materials and may be transparent, translucent or opaque. The body 12 and lid 14 are preferably formed from a molded antibacterial plastic. Antibacterial material is preferred in order to prevent transmission of bacteria to the contents. One suitable antibacterial material is plastic material that incorporates Microban® resin. Microban® resin is an antibacterial resin material sold by Microban Products Company, Charlotte, N.C. The molded plastic may be brightly colored, metallicized, or rubber-coated in order to provide an attractive and/or useful exterior for the intended user. To the extent the body 12 is opaque and the contents cannot be viewed, a translucent or transparent fluid-level window 16 may be incorporated. The window and/or body may include fluid-level markings 18 which indicate the level of the contents within the container 10.

Figure 2:
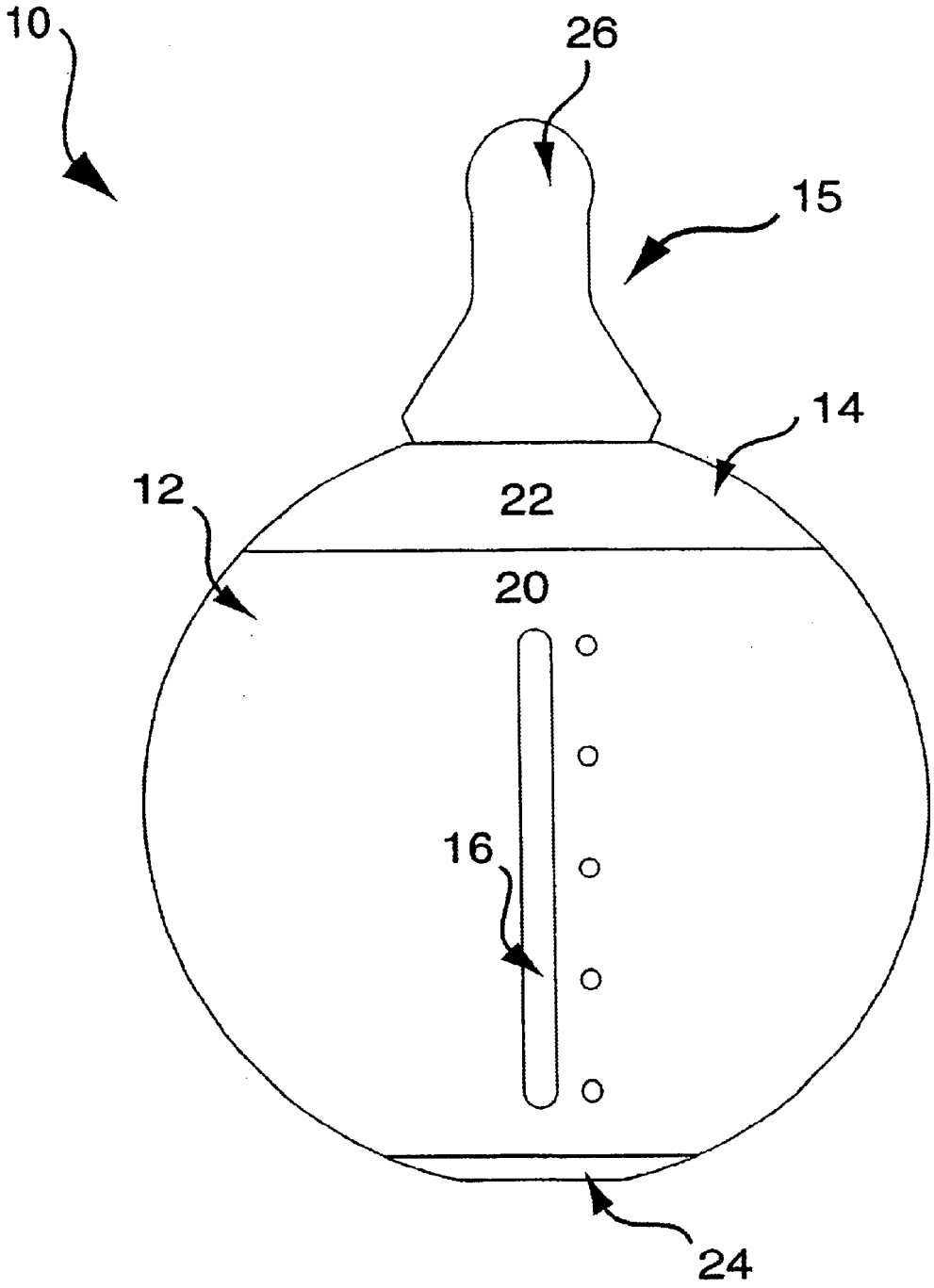
FIG. 2 is a side view of the embodiment of the invention shown in FIG. 1.
Figure 2A:
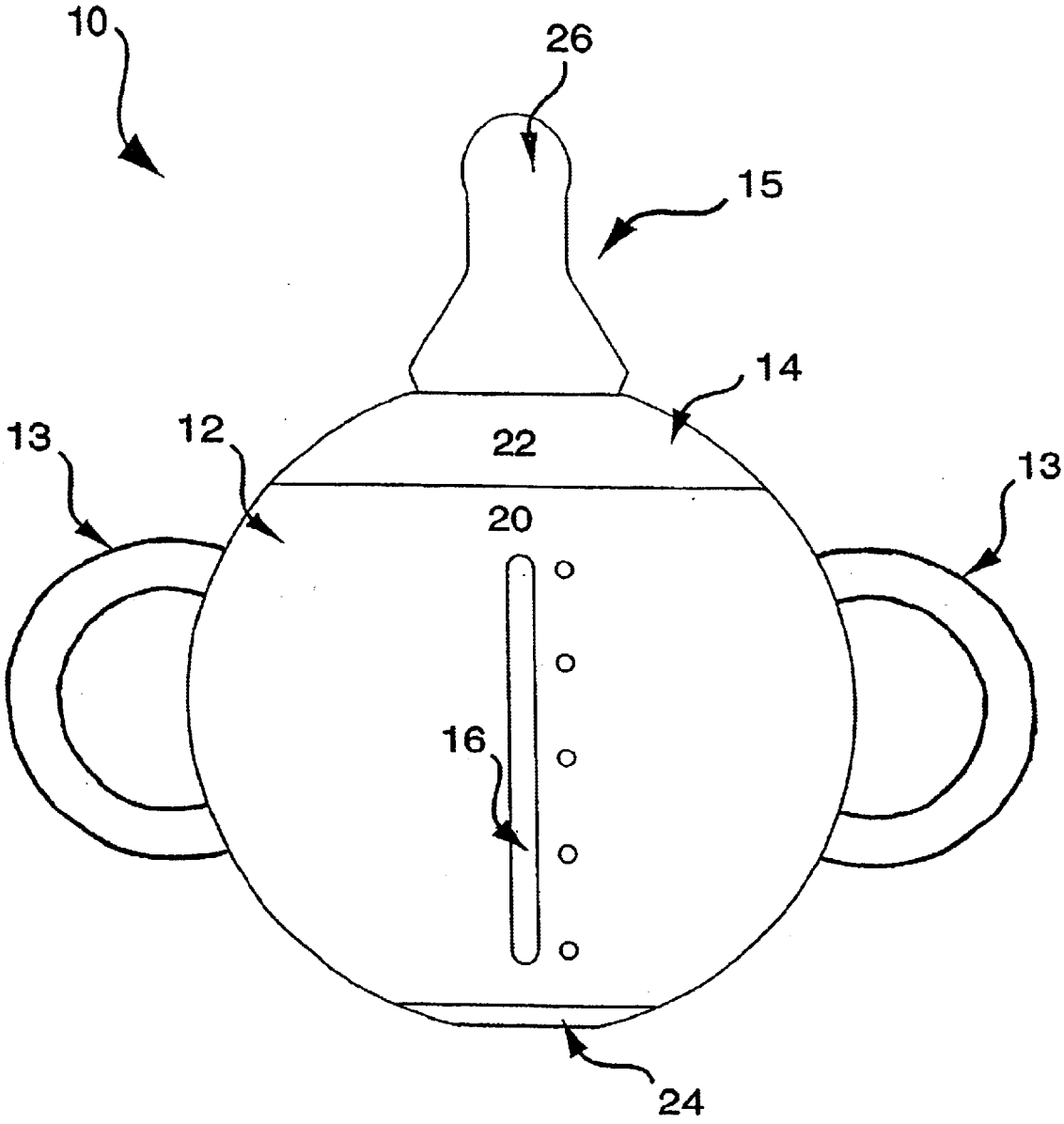
Figure 2B:
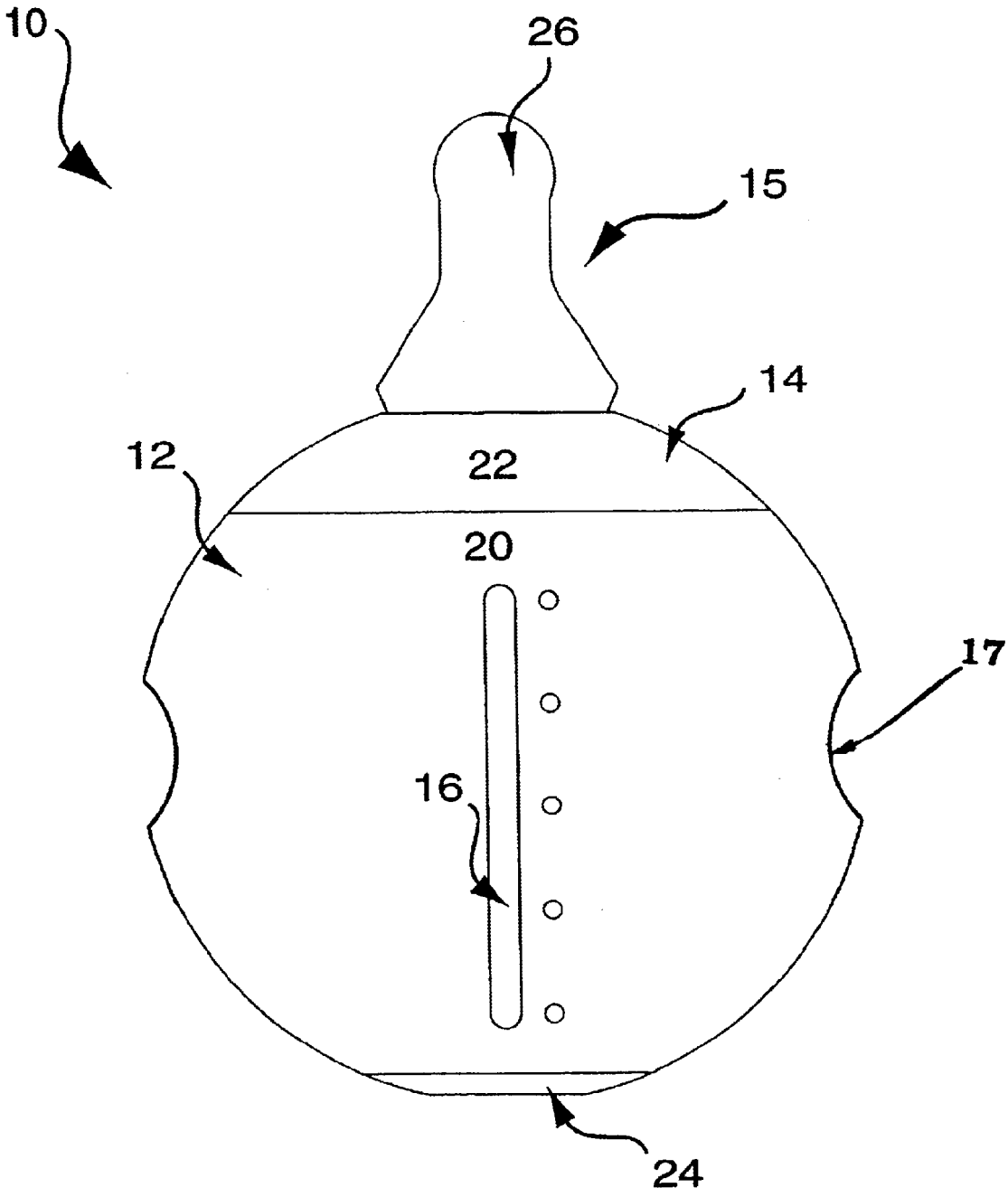

As shown is FIG. 2, the body 12 and the lid 14 have outer surfaces 20, 22 that enable the container 10 to be easily gripped or cupped by an adult or child's hands with varying degrees of dexterity. The outer surface may be a coating applied to the material of the body 12 or lid 14, such as a plastic or rubber material. The outer surface can be made from material that minimizes thermal conduction, thereby assisting in maintaining the contents at a desired temperature and minimizing discomfort to the user. Alternately or in addition to the coating, the outer surfaces 20, 22 may be textured to decrease the chances of the container 10 slipping out of a user's hands.

In addition, the outer surface 22 of the lid 14 is preferably shaped so that it gently curves away from the user's face to facilitate drinking from container 10. Preferably the lid 14 is similarly shaped as the body 12 so that it continues to form a semi-spherical shaped container as illustrated. This is particularly beneficial for infants and toddlers as it assists in providing the container 10 with an amusing and entertaining appearance.

The lid 14 may be made from material that is different than the body 12. Preferably the outer surface 22 of the lid 14 is soft and dimpled which allows the user's saliva to drain away from the mouth, thereby reducing saliva irritation.

Body 12 may optionally include handles 13 (shown in broken lines in FIG. 2) located on outer surface 20. The handles 13 make container 10 easier to hold and can be any convenient shape and size. The handles can be integrally formed or separately attached to the container. Also, the handles 13 can extend out from the sides of the container 10 as shown or may be made as depressions or apertures formed within the body 12.

The body 12 also includes a counterweight or anti-tip weight 28 located in the base portion 24 or suspended within container. As discussed above, the container 10 has a rounded base 24. The rounded base 24 allows the container 10 to wobble when placed on a flat surface (not shown). The counterweight 28 is positioned and weighted so that, acting in combination with the container's rounded base 24, it causes container 10 to self-right when the central axis 200 of the dispenser 15 is at an angle with respect to a vertical axis. This self-righting or anti-tipping configuration prevents or minimizes the occurrence of the dispenser 15 touching a surface upon which the container 10 may be placed. The wobbling aspect of the invention also is beneficial for engaging the user's imagination.

Figure 3:
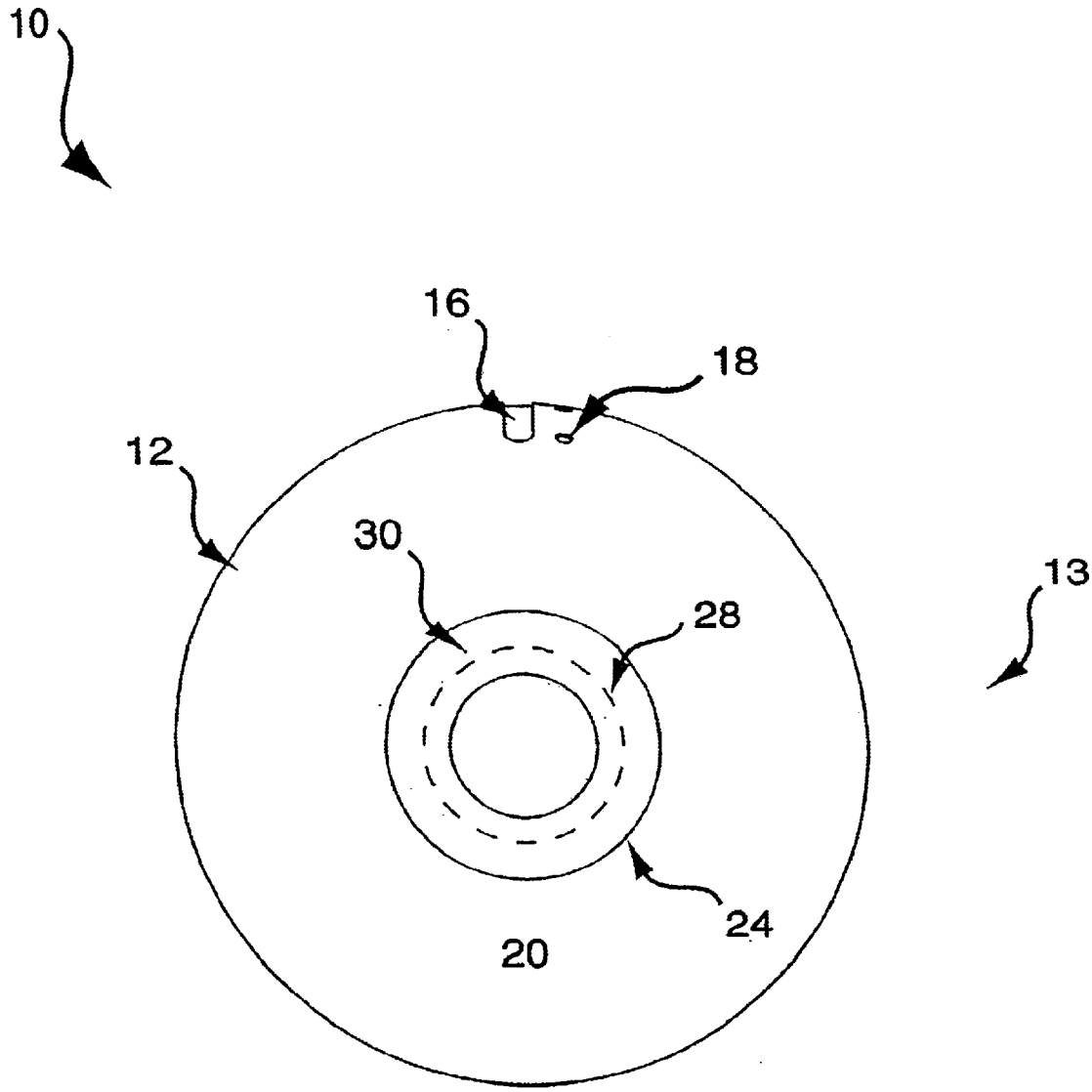
FIG. 3 is a bottom view of the embodiment of the invention shown in FIG. 1.
Figure 4:
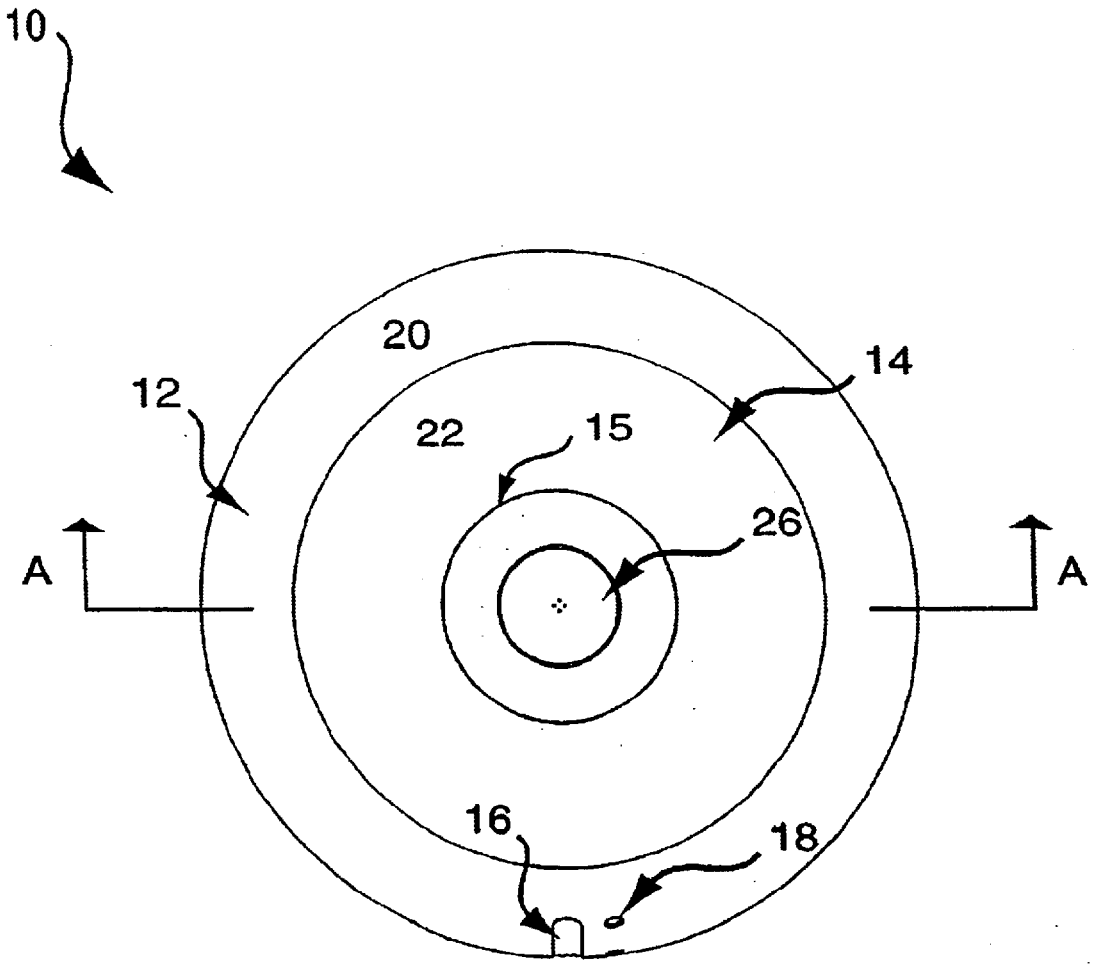
FIG. 4 is a top view of the embodiment of the invention shown in FIG. 1.

FIG. 3 illustrates the bottom of the body 12. The counterweight 28 may be engaged directly into the container 10, preferably so that it is centrally located in to base 24. If the weight 28 is attached directly to the container 10, it is preferably shaped so that, in combination with the base 24, it defines a semi-spherical or rounded surface. More preferably, the counterweight 28 is located within a cavity formed in the base 24 (shown in FIG. 5). A cap 30 is attached to the base to retain and/or secure the counterweight 28 to the base 24. Counterweight 28 can be formed of any suitable material and should have a weight that is sufficient to prevent tipping of a container filled with liquid or semi-solid food. Preferably, the counterweight is made from a material which absorbs thermal energy (i.e., absorbs heat and/or cold), such as a thermal gel. Thermal gels are well known. One type of thermal gel that is suitable is a water and propelene glycol mixture, such as TheraFlex sold by ColdIce Inc. of Oakland, Calif. or TemTro™ sold by TemTro, Inc. of Alpharetta, Ga. Inert and/or non-toxic materials are preferable so as to minimize any safety risk to the user should the counterweight 28 become exposed.

The counterweight 28 can be formed in any convenient shape. In the embodiment illustrated in FIG. 5, counterweight 28 is cylindrical in shape. Such a shape is preferable in a rounded container since it counters tipping in all directions equally. As discussed above, the counterweight can also be suspended within the container, such as by attachment to the interior walls of the body 12 or attachment to and suspended down from an interior surface of the lid 14. It is further contemplated that the counterweight 28 may be located between the interior and exterior surfaces of the body 12. In such an embodiment, the location and/or structure of the container is preferably configured to facilitate heating/cooling of the contents more readily than the heating/cooling of the outer surface.

Figure 5:
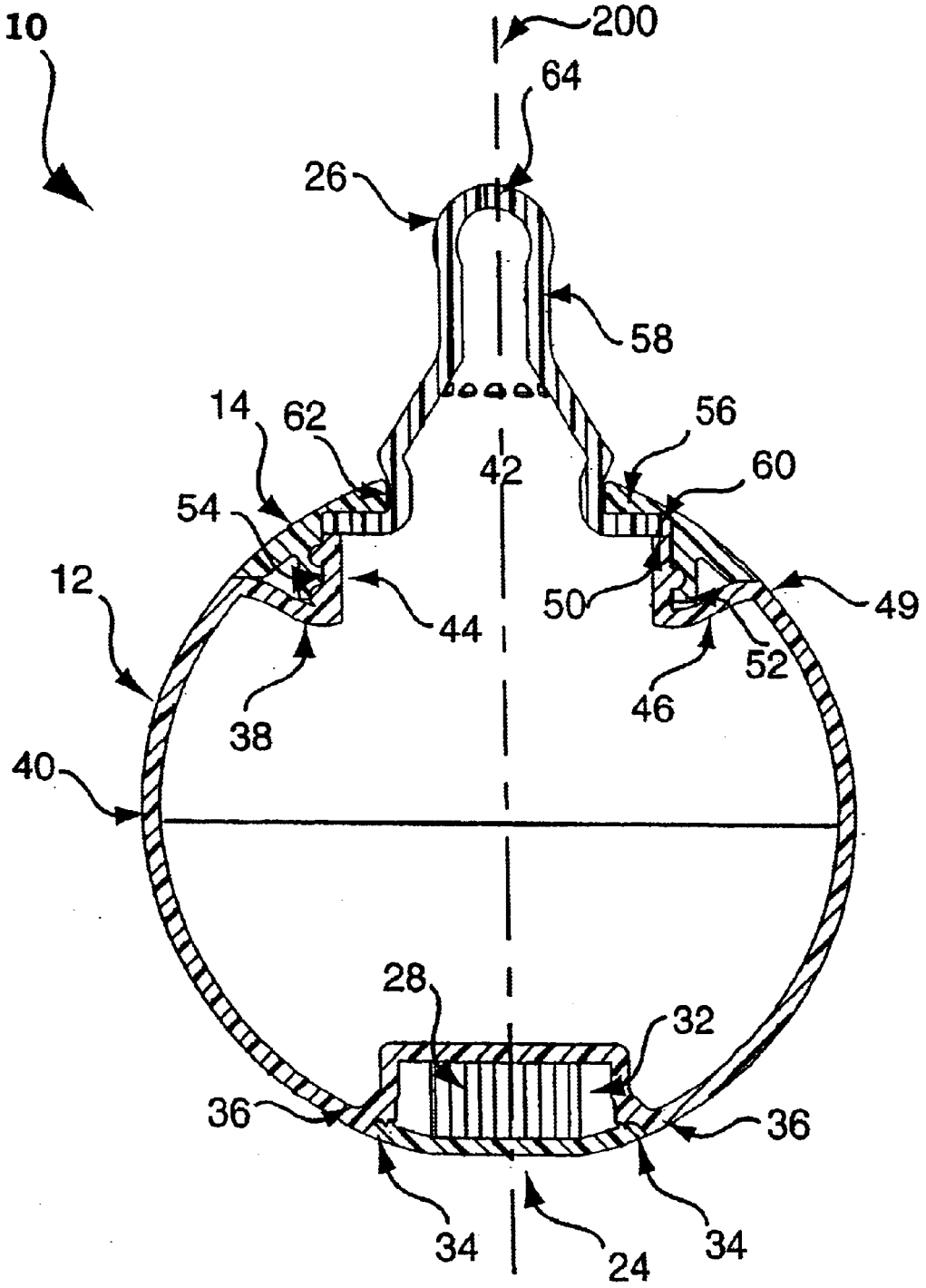
FIG. 5 is a cross-sectional view of the embodiment of the invention shown in FIG. 1, taken along line 5—5 of FIG. 4.

Referring now to FIG. 5, the counterweight 28 is preferably contained within an inverted cup-shaped recess 32 that is formed in the base 24 of the body 12. The recess 32 should be sized and shaped as to receive the counterweight 28 and prevent or limit movement of the counterweight. The cap 30 is preferably made of the same material and colored the same as the body 12, although it need not be so. The cap 30 may be secured by any convenient means. In one embodiment, which is preferable for small children such as infants, the cap 30 and/or the counterweight 28 is fixedly attached so as to prevent any choking hazard. In another embodiment, the cap 30 includes a groove 34 that engages with a tongue 36 formed in the base 24 of the body 12. In this embodiment, the cap 30 would be press-fit into the base 24 such that the groove 34 engages with the tongue 36. The cap 30 and/or counterweight 28 could, alternatively, be threaded onto the base 24.

While the recess in the embodiment of FIG. 5 is shown formed in the body 12, it is also contemplated that the counterweight 28 may be attached directly into an opening formed in the base 24. In that embodiment, the attachment of the counterweight must be such that no leakage occurs.

As shown in FIG. 5, the body 12 includes an upper portion 38 and a substantially semi-spherical or rounded lower portion 40. The lower portion 40 defines a cavity 42, which is intended to retain the liquid or semi-solid food. The spherical or rounded shape of the lower portion 40 naturally reduces the amount of air ingested by a user drinking from the container 10 since most of the volume may be filled with liquid, thereby displacing the air within the container 10. The upper portion 38 of the body 12 includes a mouth 44 that allows the fluid to flow from the cavity 42 into the dispenser 15 (which in the illustrated embodiment is a nipple 26.) The upper portion 38 also includes a preferably substantially flat annular surface 46 that connects the mouth 44 to the lower portion 40. The body 12 also includes an elbow 49 that provides the transition between the flat surface 46 and the lower portion 40.

The mouth 44 is preferably cylindrically shaped and terminates at a rim 50. The mouth 44 preferably includes threads 48 or similar attachment mechanisms for removably receiving the lid 14.

The lid 14 preferably includes a rim 56 from which downwardly depends a cylindrical portion 52. The cylindrical portion 52 preferably includes threads 54 which threadingly engage or mate with the threads 48 formed on the mouth 44. As such, the lid 14 is secured to the mouth 44 by rotating the lid 14 in one direction relative to the mouth 44, and may be removed by rotating the lid 14 in the opposite direction relative to the mouth 44.

The dispenser 15 is preferably removably attached to the lid 14. By making the dispenser removable, the dispenser can be easily replaced is it becomes damaged or worn. Furthermore, the dispenser 15 can be changed to suit the needs of the user, thereby permitting the same container to be used over many years and by different users. FIG. 5 illustrates the use of a conventional rubber nipple 26. The nipple 26 preferably includes a head 58, a lip 60 and a constriction 62. The head 58 includes an aperture 64 that allows liquid to flow therethrough. The constriction 62 is adapted to removably engage the rim 56 of the lid 14 as shown, thereby securing the nipple 26 to the lid 14. When lid 14 is secured to the mouth 44, the lip 60 is preferably positioned between the rim 50 of the mouth 44 and the rim 56 of the lid 14, thereby creating a compression seal for preventing leakage.

Figure 6:
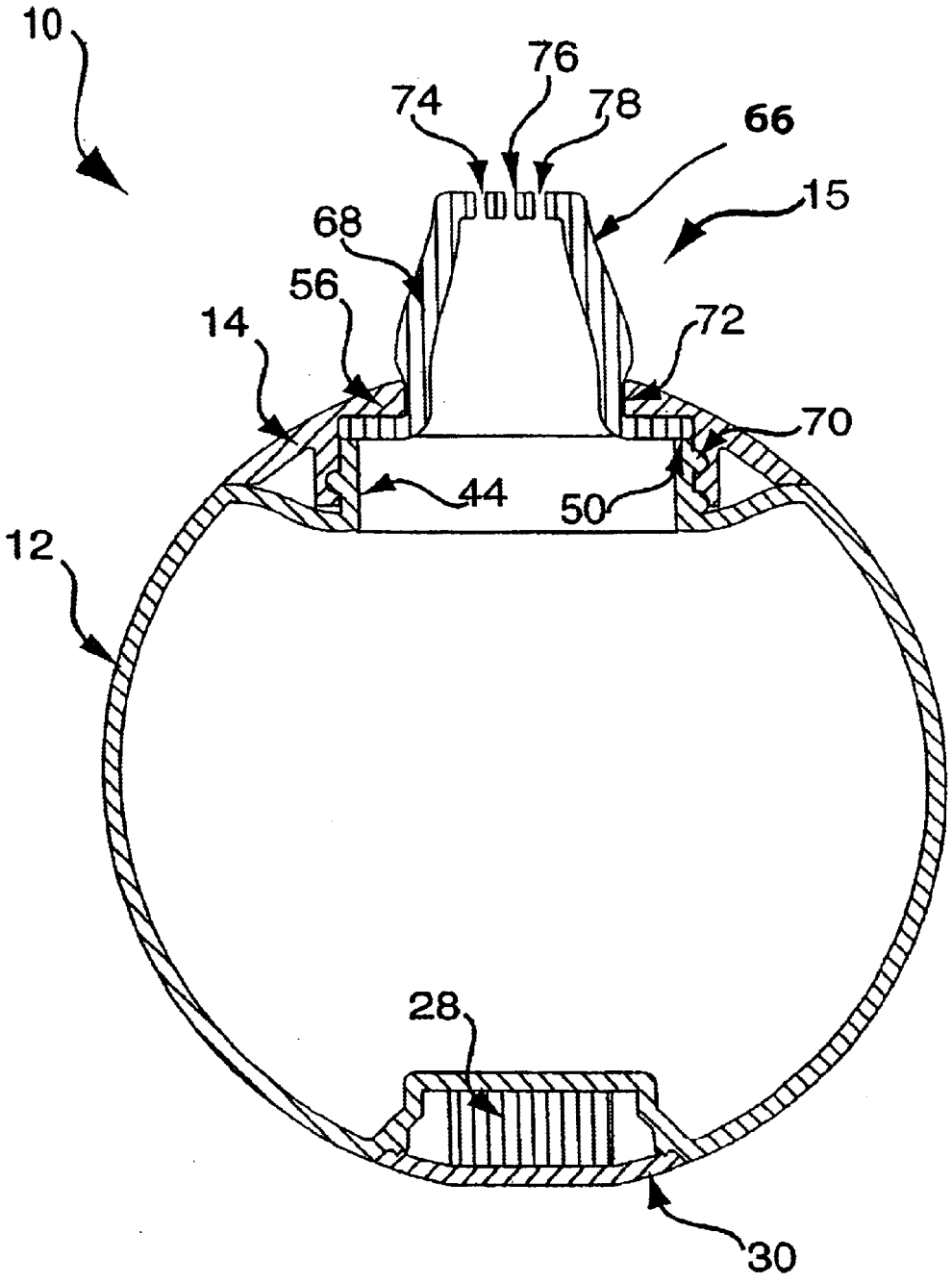
FIG. 6 is a cross-sectional view of another embodiment of the invention with a lid that includes a sipping spout.

FIG. 6 shows another embodiment of the container 10. In this embodiment the container lid 14 has a sipping spout 66 which is intended for use by toddlers or more mature infants. The sipping spout 66 is preferably formed of rigid or flexible plastic and includes a head 68, a lip 70 and a constriction 72. As in the prior embodiment shown in FIG. 5, the rim 56 of the lid 14 is received within the constriction 72 and the lip 70 forms a compression seal when the lid 14 is secured to the mouth 44. The head 68 of the sipping spout 66 preferably includes a plurality of apertures (three shown and designated 74, 76, and 78), which allow liquid to pass through the sipping spout 66 more easily than the nipple 26.

Figure 7:
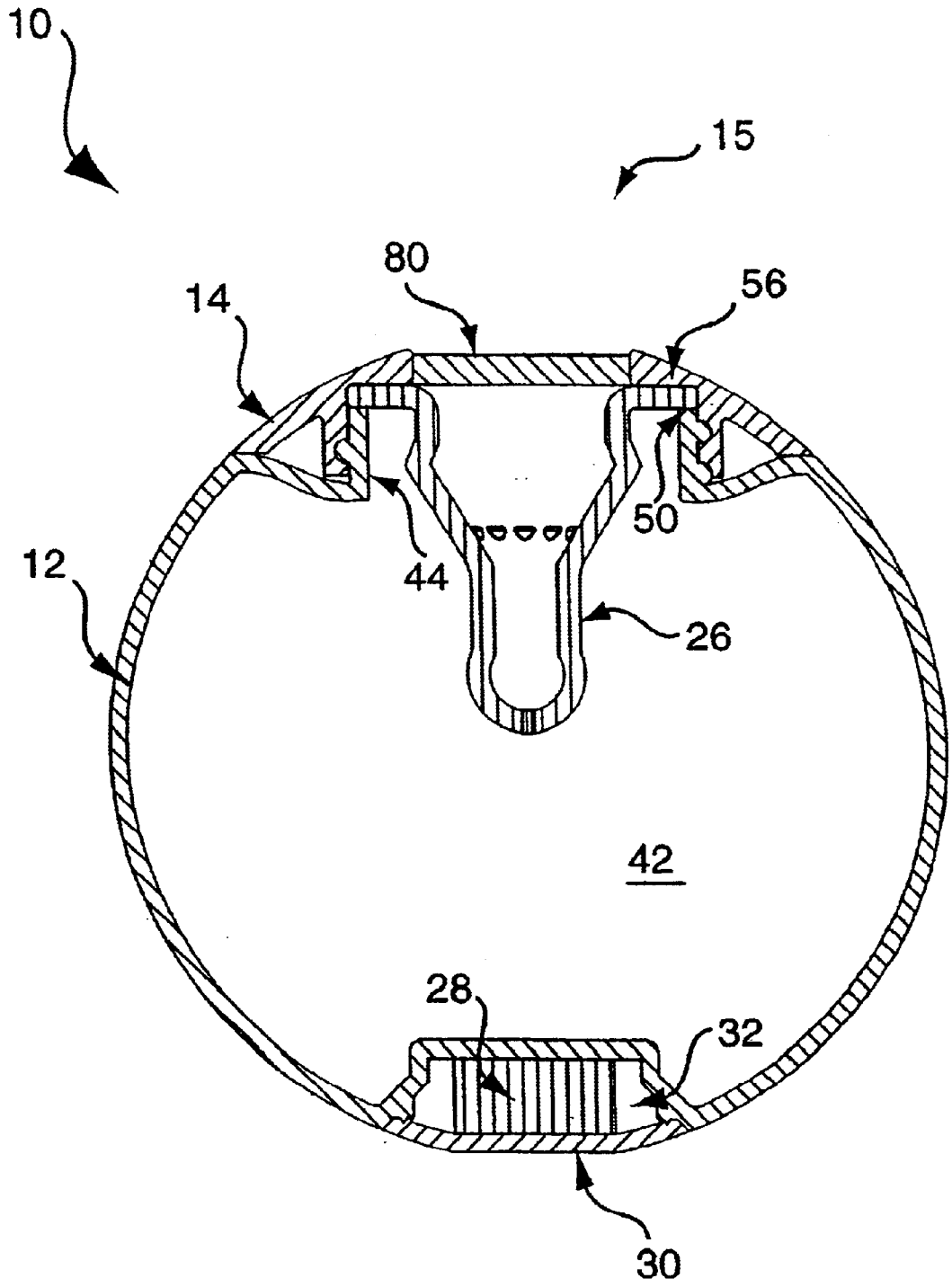
FIG. 7 is a cross-sectional view of the invention with a lid that includes a sealing cap.

FIG. 7 shows another embodiment of the container 10. In this embodiment, a sealing disc 80 is included. When in use, the sealing disc 80 is positioned between the rim 56 of the lid 14 and the rim 50 of the mouth 44, thereby preventing passage of fluid from the cavity 42 out of the container 10. The sealing disc 80 is intended to be used when the container 10 is being stored or transported in order to prevent leakage. As shown in FIG. 7, the nipple 26 may be inverted and placed between the sealing disc 80 and the rim 50 of the mouth 44.

Figure 8:
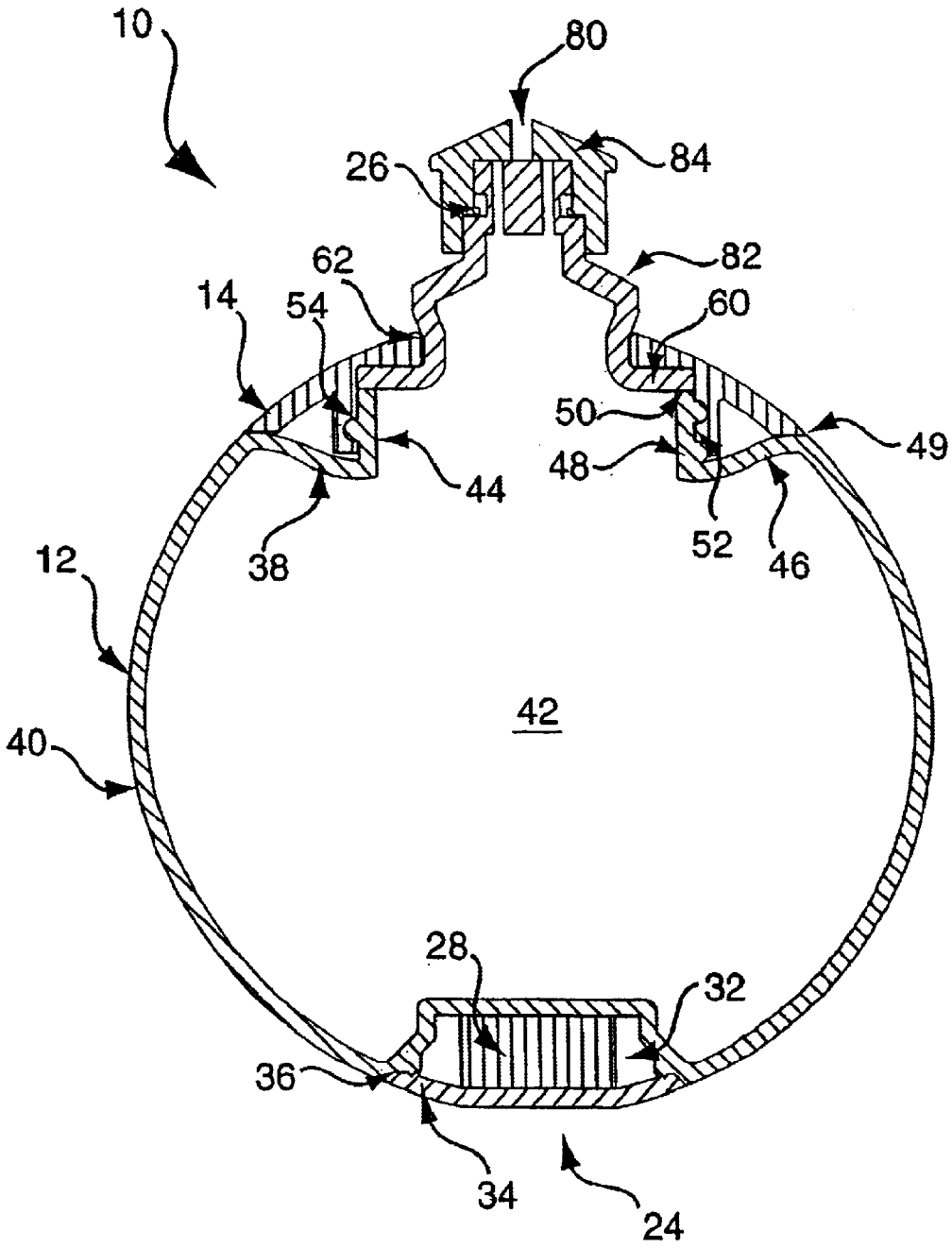
FIG. 8 is a cross-sectional view of another embodiment of the invention with a lid that includes a pop-up sports spout.

FIG. 8 illustrates another embodiment of container 10. In this embodiment the container lid 14 has a pop-up sports spout 80 which is intended for use by children and adults. Pop-up sports spout 80 is preferably formed of rigid plastic and includes a spout base 82 which is attached to the lid 14 in a similar manner as discussed above with respect to the other dispensers 15. A spout cap 84 is slidably attached to the spout base 82. Pop-up sports spouts are well known in the art and, thus, no further discussion is needed.

Figure 9:
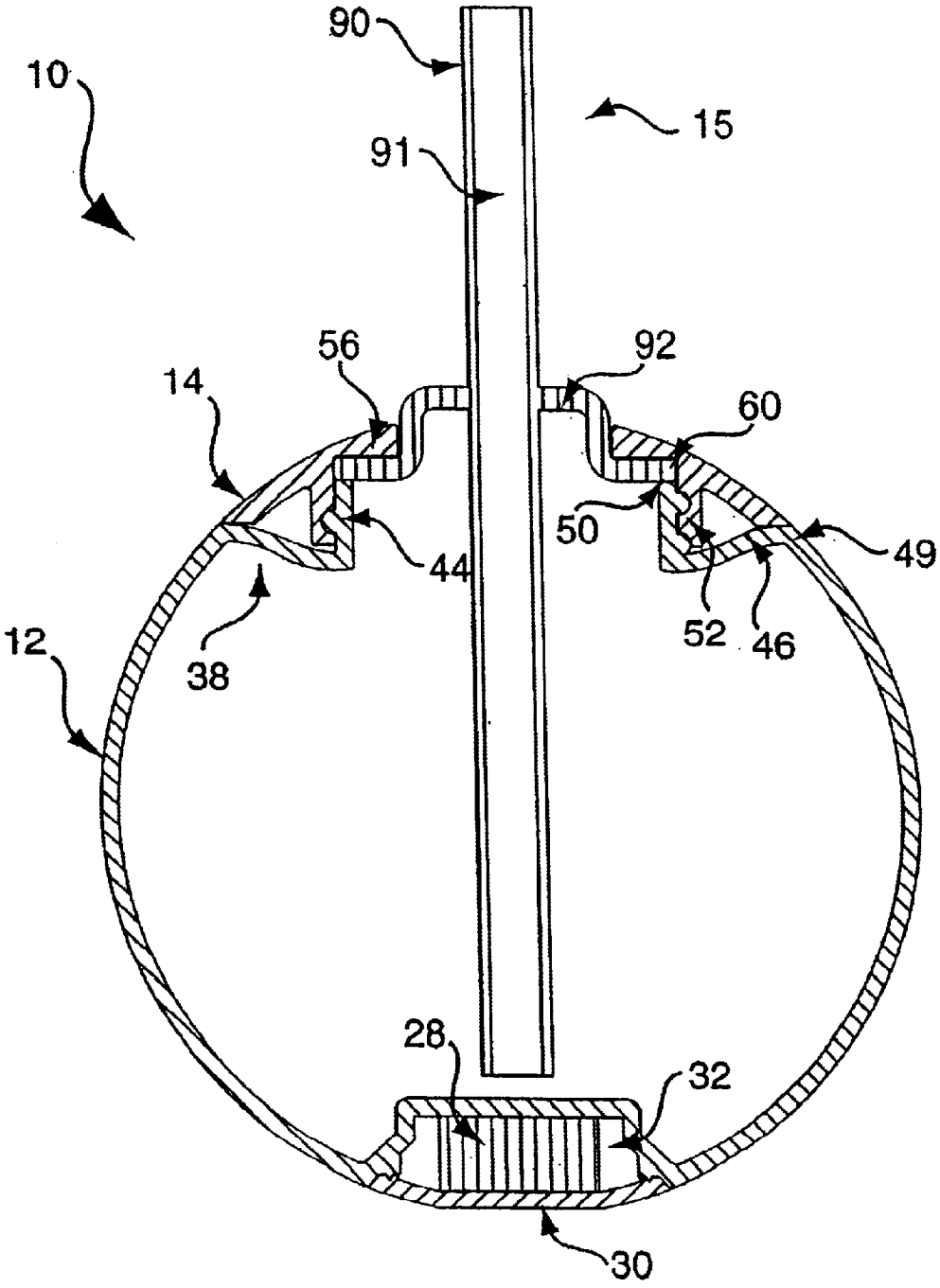
FIG. 9 is a cross-sectional view of another embodiment of the invention with a lid that includes a straw.
Figure 10:
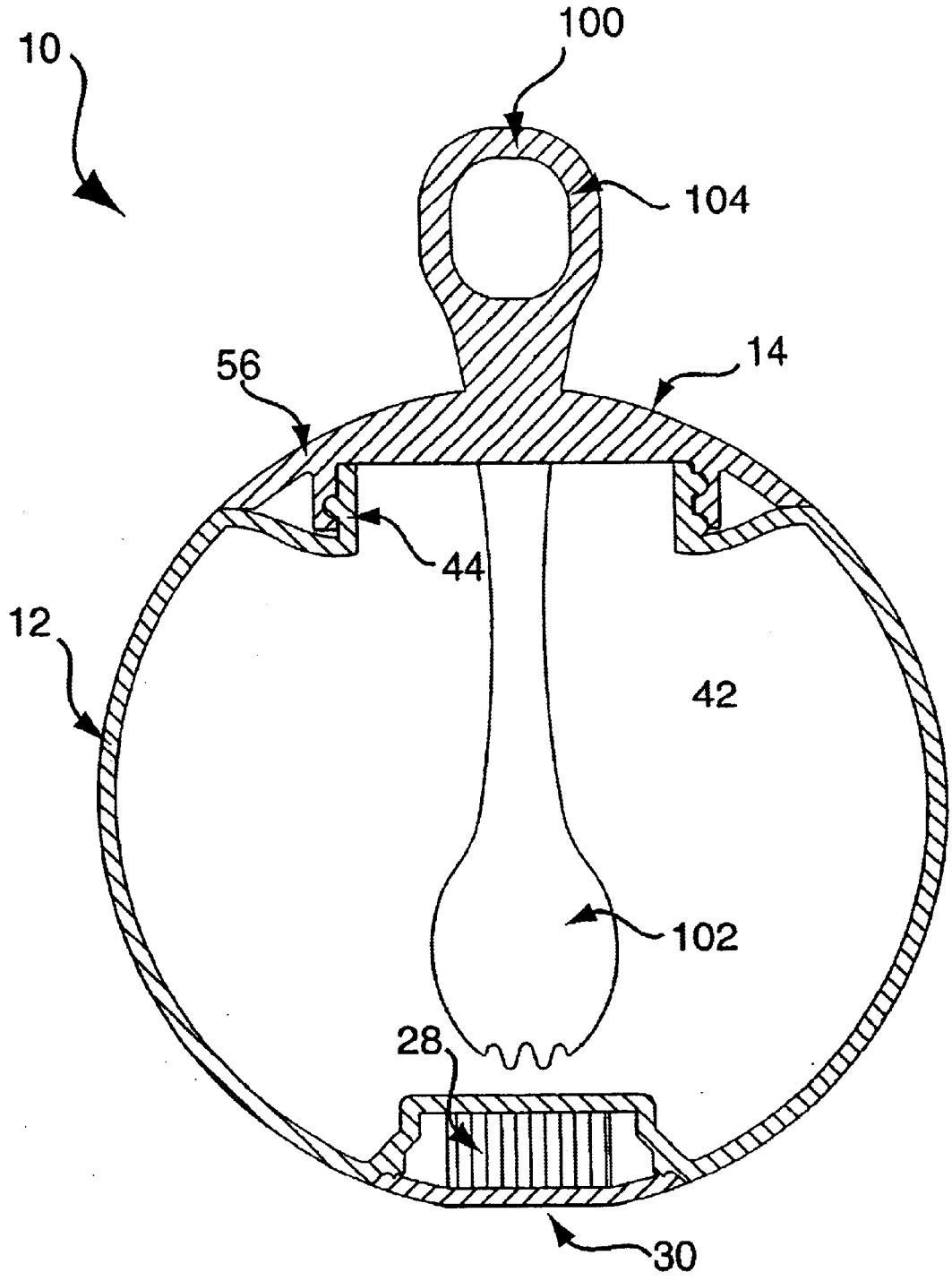
FIG. 10 is a cross-sectional view of another embodiment of the invention with a lid that includes a utensil with a fork and/or spoon portion.

FIG. 9 shows another embodiment of the container 10. In this embodiment the dispenser 15 is a straw 90 which is intended for use by children, adults, and the infirmed. The straw 90 is preferably formed of rigid plastic and includes a cylindrical tube portion 91 which defines a passage for fluid to flow out of the container 10. A cap 92 is attached to the lid 14 in a similar manner as discussed above with respect to the other dispensers 15. The straw 90 is either formed integral with the cap 92 or may be inserted through an aperture in the top of the cap 92.

FIG. 10 shows another embodiment of the container 10. In this embodiment, the dispenser is a utensil 100 that is attached to the lid during storage and/or transport. The utensil 100 preferably includes a fork end 102 and a spoon end 104. The utensil is intended to be used when the container 10 contains semi-solid food. The utensil 100 may be formed integral with the lid 14 or may be removable from the lid 14. If the utensil 100 is removable, it preferably engages with the lid 14 by extending through an aperture formed in the top of the lid 14. Preferably there is a rubber or other type of seal located between the utensil 100 and the lid 14 to prevent leakage.

The present invention provides a novel container for food items, such as liquids and semi-solid foods. The container design prevents or minimizes the occurrence of accidental tipping, thus reducing spillage and contamination of the dispenser. The design furthermore provides amusement and increases hand eye coordination for young children, such as infants and toddlers.

Although the present invention has been described and illustrated with respect to the exemplary embodiments thereof, it should be understood by those skilled in the art that the foregoing and various other changes, omissions and additions may be made therein and thereto, without parting form the spirit and scope of the present invention.

What is claimed is:

1. A container for storing and dispensing fluids comprising:

a body having a substantially rounded bottom and side walls, the bottom and side walls defining an interior cavity;

a counterweight in the bottom wall of the container and adapted to self-right the container to prevent tipping; and a lid removably attached to the body, the lid including a dispenser for dispensing liquids from within the container, the lid having a portion of its outer contour with a shape that substantially complements the rounded shape of the side walls so as to provide the container with the appearance of a unitary rounded shape;

wherein the body and lid form a substantially spherical container; and wherein the counterweight includes a thermal gel material.

2. The container according to claim 1, wherein the body is at least substantially semi-spherical in shape and the lid has a soft curved outer surface with dimples.

3. The container according to claim 1, wherein the body and lid made from antibacterial plastic.

4. The container according to claim 1, wherein the body has an outer surface which is textured.

5. The container according to claim 1, wherein the body is made from material that is substantially translucent.

6. The container according to claim 1, wherein the body is made from material that is substantially opaque and wherein the body includes a substantially translucent fluid-level window which permits viewing of the level of the contents inside the container.

7. The container according to claim 1, wherein the dispenser is selected from a group consisting of a nipple, a sipping spout, a pop-up spout, a straw, and a utensil.

8. The container according to claim 1, wherein the container includes handles.

9. The container according to claim 8, wherein the handles are depressions formed within body of container.

10. A container for storing and dispensing fluids comprising:

a body having a substantially rounded bottom and side walls, the bottom and side walls defining an interior cavity;

a counterweight in the bottom wall of the container and adapted to self-right the container to prevent tipping; and a lid removably attached to the body, the lid including a dispenser for dispensing liquids from within the container, the lid having a portion of its outer contour with a shape that substantially complements the rounded shape of the side walls so as to provide the container with the appearance of a unitary rounded shape;

wherein the body and lid form a substantially spherical container; and wherein the body includes a portion which has a thermal gel material, and an outer portion which inhibits the passage of thermal energy.

11. A container for storing and dispensing fluids, the container having a substantially semi-spherical outer surface, the container comprising:

a body having a top, a bottom and a side wall which form a substantial portion of the container, the top, bottom, and side wall defining an interior cavity, the body having a central axis extending from the bottom to the top;

a lid removably attached to the top of the body, the lid including a dispenser for dispensing fluids from within the container, the lid having a portion of its outer contour with a shape that substantially complements the rounded shape of the side wall so as to provide the container with the appearance of a unitary rounded shape; and a counterweight located in the bottom of the container, the counterweight positioned so as to maintain the central axis substantially vertical when the container is placed on a surface, wherein the counterweight includes a thermal gel material.

12. The container according to claim 11, wherein a least a portion of the container has a soft textured outer surface.

13. The container according to claim 11, wherein the body and lid include antibacterial material.

14. The container according to claim 11, wherein the body is made from material that is substantially translucent.

15. The container according to claim 11, wherein the body is made from material that is substantially opaque and wherein the body includes a fluid-level window which permits viewing of the level of the contents inside the container.

16. The container according to claim 11, wherein the dispenser is selected from a group consisting of a nipple, a sipping spout, a pop-up spout, a straw, and a utensil.

17. The container according to claim 11, wherein the container includes handles.

* * * * *